US006046660A

United States Patent [19]

Gruner

[11] Patent Number: 6,046,660

[45] Date of Patent: Apr. 4, 2000

[54] LATCHING MAGNETIC RELAY ASSEMBLY WITH A LINEAR MOTOR

[76] Inventor: Klaus A. Gruner, 1275 Broadway, Village of Lakewood, Ill. 60014

[21] Appl. No.: 09/287,469

[22] Filed: Apr. 7, 1999

[51] Int. Cl.[7] ..... H01H 51/22

[52] U.S. Cl. ..... 335/78; 335/128; 335/132

[58] Field of Search ..... 335/78–86, 128, 335/132

[56] References Cited

U.S. PATENT DOCUMENTS

| | | | |
|---|---|---|---|
| 4,092,620 | 5/1978 | Schuessler et al. | 335/128 |
| 4,101,855 | 7/1978 | Drapeau | 335/106 |
| 4,795,994 | 1/1989 | Hoffmann | 335/82 |
| 5,546,061 | 8/1996 | Okabayashi et al. | 335/78 |
| 5,880,655 | 3/1999 | Dittmann et al. | 335/78 |

*Primary Examiner*—Lincoln Donovan
*Assistant Examiner*—Tuyen T. Nguyen
*Attorney, Agent, or Firm*—Meroni & Meroni; Charles F. Meroni, Jr.

[57] ABSTRACT

The present invention is a latching magnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin. Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

23 Claims, 5 Drawing Sheets

LATCHING MAGNETIC RELAY ASSEMBLY WITH A LINEAR MOTOR

BACKGROUND OF THE INVENTION

1. Field of the Invention

The present invention relates to a latching magnetic relay assembly with a linear motor capable of handling current transfers of up to and greater than 100 amps.

2. Description of the Prior Art

There are a few designs for latching magnetic relay assemblies currently in the prior art. These latching magnetic relay assemblies typically include a relay motor assembly that is magnetically coupled to an actuation assembly. The actuation assembly is then operatively coupled to a contact spring that is positioned opposite a pair of conductively isolated contact points. The relay motor typically drives the actuation assembly which in turn drives the contact spring into contact with a pair of contact points positioned directly across from it.

The conductive springs typically serve a dual purpose. They ensure good contact with the contact points, and they form a conductive pathway between the contact points. Conductive springs are typically made of copper or a copper alloy, the copper alloys typically have lower conductivity than plain copper. Plain copper can typically sustain less than 20 amps per square millimeter without causing excess heat build up in the copper. Excess heat build up in the conductive springs will cause the conductive spring to lose there spring property. This results in a loss of contact pressure which leads to increased contact resistance which in turn causes the relay to fail. Consequently, most latching magnetic relays can only sustain currents of less than 20 amps per square millimeter through their copper conductive springs.

In order to increase current density while minimizing the heat generated by higher currents only two options are currently available. One is to make the conductive spring wider, requiring an increase in the size of the relay and increasing the bending force needed by the actuator assembly and the relay motor. The other option is to increase the thickness of the spring which will also increase the bending force needed by the actuator assembly and the relay motor. Consequently, typical magnetic latching relays are not particularly suited for applications which require higher current flows of up to 100 amps.

Also, current relay motors typically have relay motors which generate a rotational movement. Contact springs typically require only a linear movement in the actuator assembly to bring it into contact with the contact points. Consequently additional pieces are required in the actuation assembly in order to convert the rotational movement generated by the relay motor into a linear movement required by most contact springs, adding to the expense of producing and assembling the latching magnetic relay.

Accordingly, there is a need for a latching magnetic relay which is capable of handling currents of up to 100 amps.

Accordingly there is also a need for a latching magnetic relay with a motor that generates a linear movement to accommodate contact assemblies which require only a linear movement.

The present invention is a latching magnetic relay assembly with a linear motor capable of transferring currents of up to 100 amps for use in regulating the transfer of electricity or in other applications requiring the switching of currents of up to 100 amps.

As will be described in greater detail hereinafter, the present invention solves the aforementioned and employs a number of novel features that render it highly advantageous over the prior art.

SUMMARY OF THE INVENTION

Accordingly it is an object of this invention to provide a latching magnetic relay that is capable of safely transferring currents of greater than 100 amps.

A further object of the present invention is to provide a latching magnetic relay with a relay motor that generates a linear movement.

To achieve these objectives, and in accordance with the purposes of the present invention the following latching magnetic relay is presented.

A relay motor assembly has an elongated coil bobbin with an axially extending cavity therein. An excitation coil is wound around the bobbin. A generally U shaped ferromagnetic frame has a plurality of core sections disposed in and extending through the axially extending cavity in the elongated coil bobbin. Two contact sections extend generally perpendicularly to the core section and rises above the relay motor assembly.

An actuator assembly is magnetically coupled to the relay motor assembly. The actuator assembly is comprised of an actuator frame operatively coupled to a first and a second generally U-shaped ferromagnetic pole pieces, and a permanent magnet. The first pole piece is mounted in overlapping relation over the second pole piece. The permanent magnet is sandwiched in between the first and second pole pieces. The actuator assembly is positioned so that the second pole piece is located in between the two contact sections of the ferromagnetic frame, and the first pole piece is lying in overlapping relation over the two contact sections of the relay motor. The first and second pole pieces are magnetically coupled to opposite contact sections.

A contact bridge made of a sheet of conductive material is operatively coupled to the actuator. The contact bridge serves as a conductive pathway between a pair of contact points generally positioned across from the contact bridge. The conductive bridge is connected to a spring, the spring serving to ensure good contact between the contact bridge and the contact points lying across from the contact bridge. A plurality of contact buttons are conductively connected to the contact bridge.

The relay motor, the actuator assembly, and the contact bridge are disposed within a housing. The housing has a contact terminal assembly attached thereto and extending through a wall of the housing. The contact terminal assembly has typically two isolated contact points positioned across the contact bridge. An air gap of typically 1.6 mm exists between the contact bridge and each contact point, with the gaps typically adding up to at least 3.0 mm for safe disconnection of power. However, the air gaps can vary to accommodate different applications and different regulatory requirement.

The present invention is driven by the movement of the pole pieces in response to the polarity of a current running through the excitation coil. A linear movement occurs when the polarity of the current running through the excitation coil causes the magnetic flux in the ferromagnetic frame to induce the first and second pole pieces to magnetically couple to the contact sections opposite the contact section that they were previously magnetically coupled to.

The resulting linear movement of the pole pieces is translated into a linear movement of the actuator assembly.

This linear movement of the actuator assembly either drives the contact bridge into contact with a pair of contact points positioned directly opposite the contact bridge, or drives the contact bridge into breaking contact with the contact points.

Other objects, features, and advantages of the invention will become more readily apparent upon reference to the following description when taken in conjunction with the accompanying drawings.

DESCRIPTION OF THE PREFERRED EMBODIMENT

The present invention is a latching magnetic relay capable of transferring currents of greater than 100 amps for use in regulating the transfer of electricity or in other applications requiring the switching of currents of greater than 100 amps.

Figure 1:
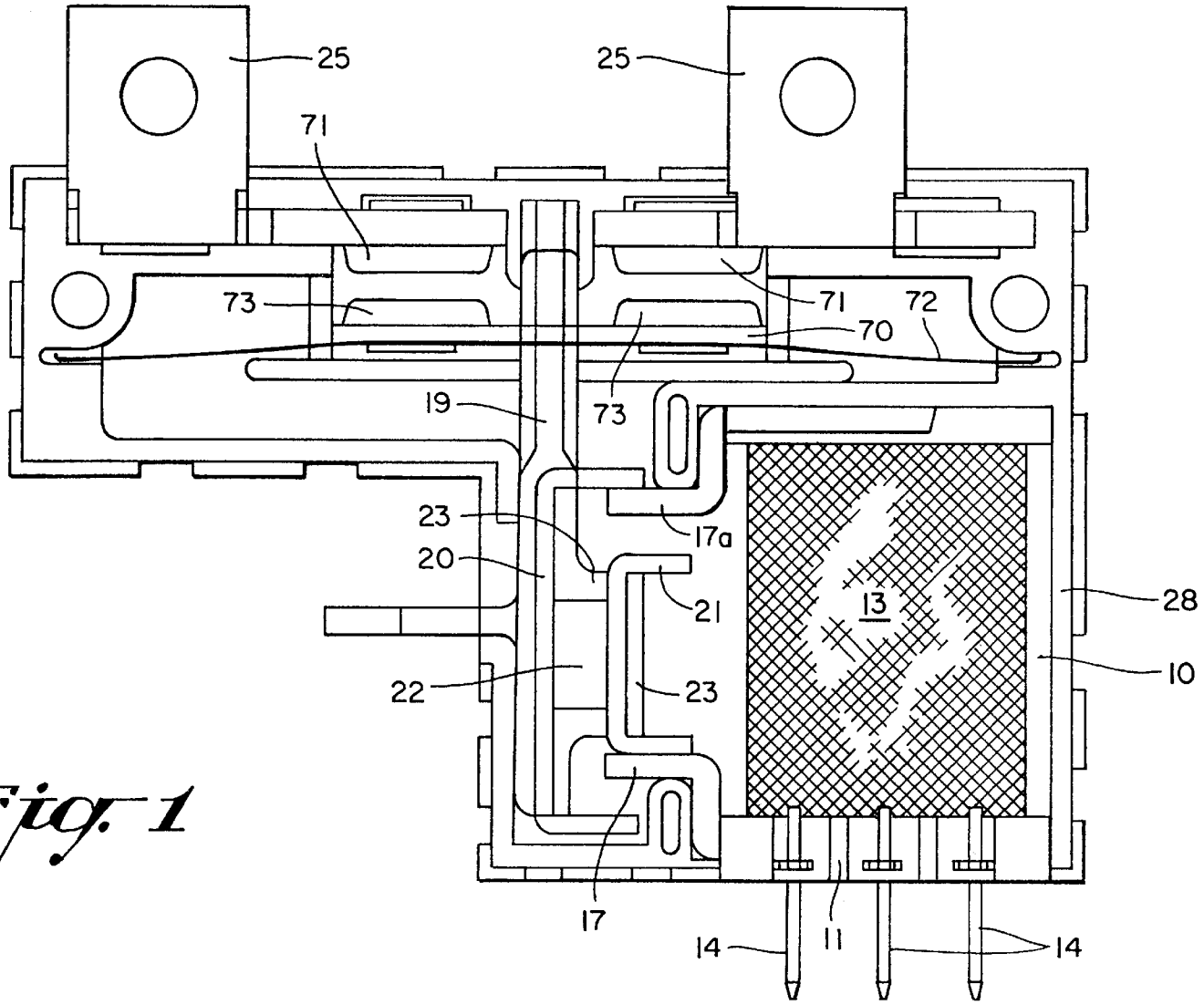
FIG. 1. An overhead planar view of the preferred embodiment of the present invention with a portion of the actuation assembly removed to show details.
Figure 2:
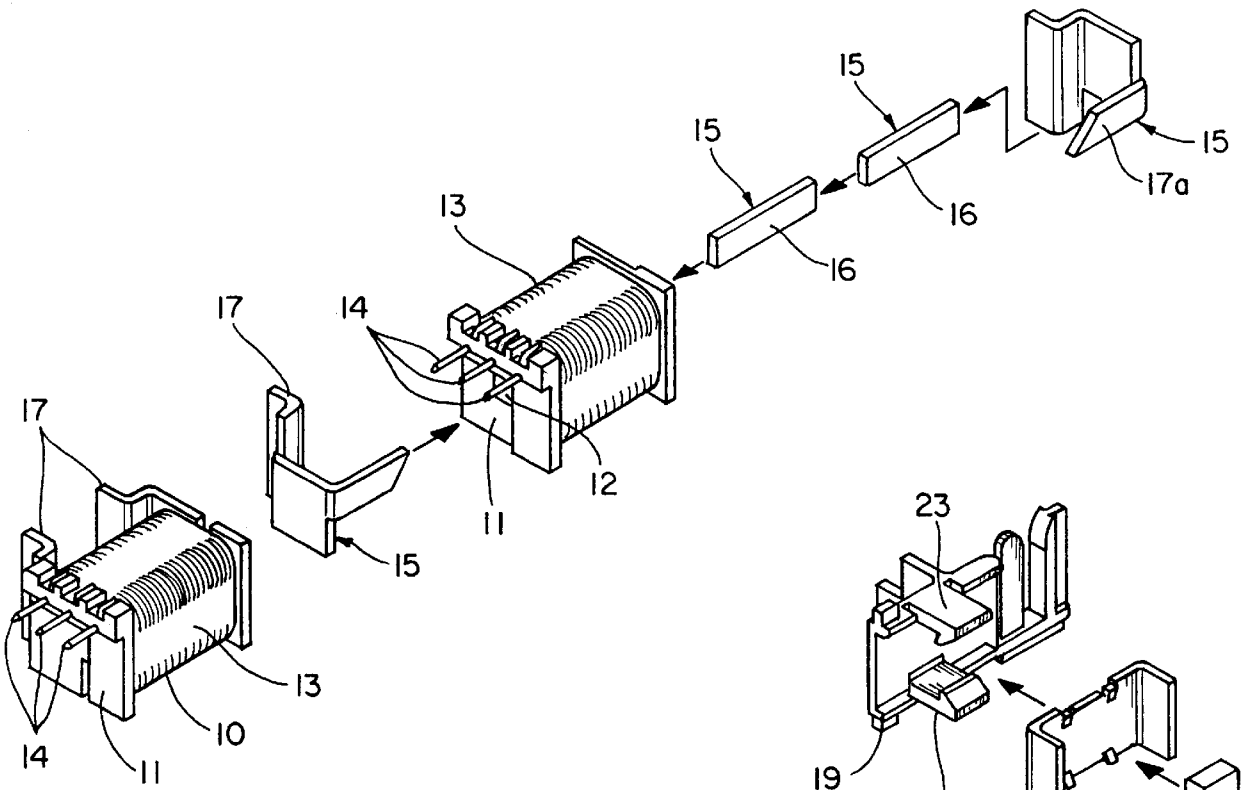
FIG. 2. An exploded view of the relay motor in the preferred embodiment of the present invention.

Referring to FIG. 1, in the preferred embodiment of the present invention, A relay motor assembly 10 has an elongated coil bobbin 11 with an axially extending cavity 12 therein. The bobbin 11 is made of a light, nonconductive material, preferably plastic. An excitation coil 13 made of a conductive material, preferably copper is wound around the bobbin. Coil terminals 14 are conductively attached to the coil and mounted on the bobbin providing a means for sending a current through the excitation coil 13.

In the preferred embodiment of the present invention, a generally U shaped ferromagnetic frame 15 has a plurality of core sections 16 disposed in and extending through the axially extending cavity in the elongated coil bobbin and a first 17 and second 17*a* contact sections extending generally perpendicularly to the core sections 16 and rising above the motor assembly. The ferromagnetic frame 15 can be a single piece or broken into an assembly of several different sections so long as continuity is maintained through all the pieces upon assembly.

Figure 3:
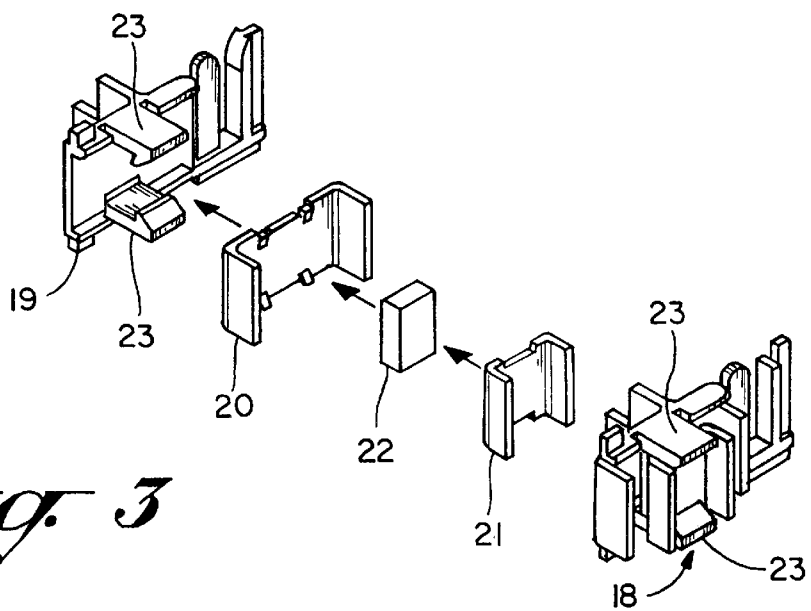
FIG. 3. An exploded view of the actuator assembly in the preferred embodiment of the present invention.

Referring to FIGS. 1 and 3, in the preferred embodiment, an actuator assembly 18 is magnetically coupled to the relay motor assembly 10. The actuator assembly is comprised of an actuator frame 19 operatively coupled to a first 20 and a second 21 generally U-shaped ferromagnetic pole pieces, and a permanent magnet. The actuator frame 19 is made of a nonconductive material, preferably plastic, and is operatively coupled to the first 20 and second 21 ferromagnetic pole pieces, and a permanent magnet 22. In the preferred embodiment, the coupling is achieved through a pair of clip portions 23 which secure the first 20 and second 21 ferromagnetic pole pieces and the permanent magnet 22 to the actuator frame 19. The first pole piece 20 is mounted in overlapping relation over the second pole piece 21. The permanent magnet 22 is sandwiched in between the first and second pole pieces.

Referring to FIG. 1 the actuator assembly is positioned so that the second pole piece 21 is located in between the first 17 and second 17*a* contact sections of the ferromagnetic frame 15, and the first pole piece 20 is lying in overlapping relation over the first 17 and second 17*a* contact sections of the relay motor 10. The first 20 and second 21 pole pieces are magnetically coupled to opposite contact sections.

Figure 4:
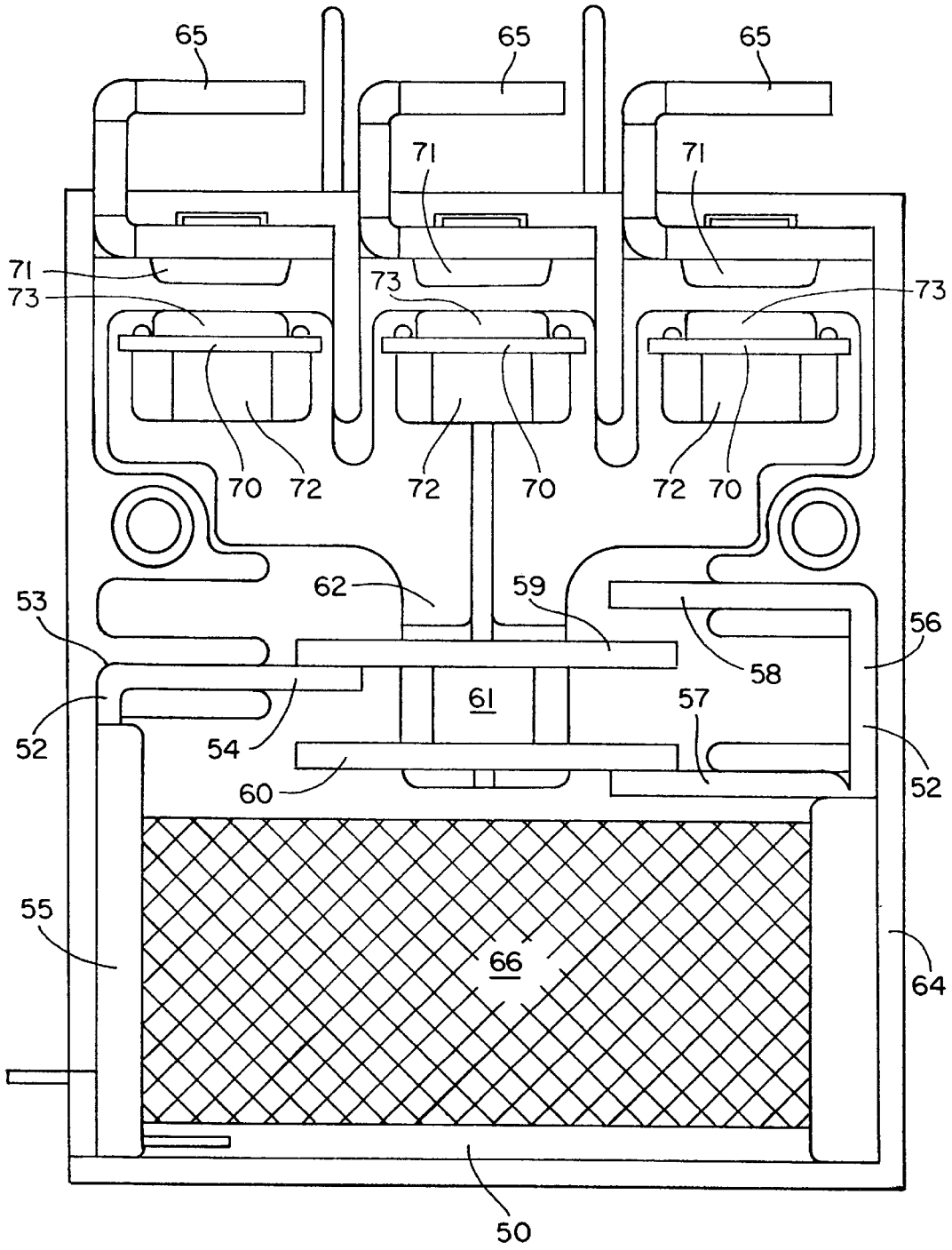
FIG. 4. An overhead planar view of the second embodiment of the present invention with a portion of the actuator assembly removed to show details.

Referring to FIG. 4, in a second embodiment of the relay motor, the ferromagnetic frame 52 has a first contact section 53 with a first tongue portion 54 extending generally perpendicularly from the first contact section 53 and above the bobbin 55, and a second contact section 56 having a second 57 and third 58 tongue portions extending generally perpendicularly from the second contact section and above the bobbin 55, the second tongue portion 57 lying below the third tongue portion 58. The ferromagnetic frame 52 can be a single piece or broken into several different sections so long as continuity is maintained through all the pieces upon assembly.

Figures 5, 6:
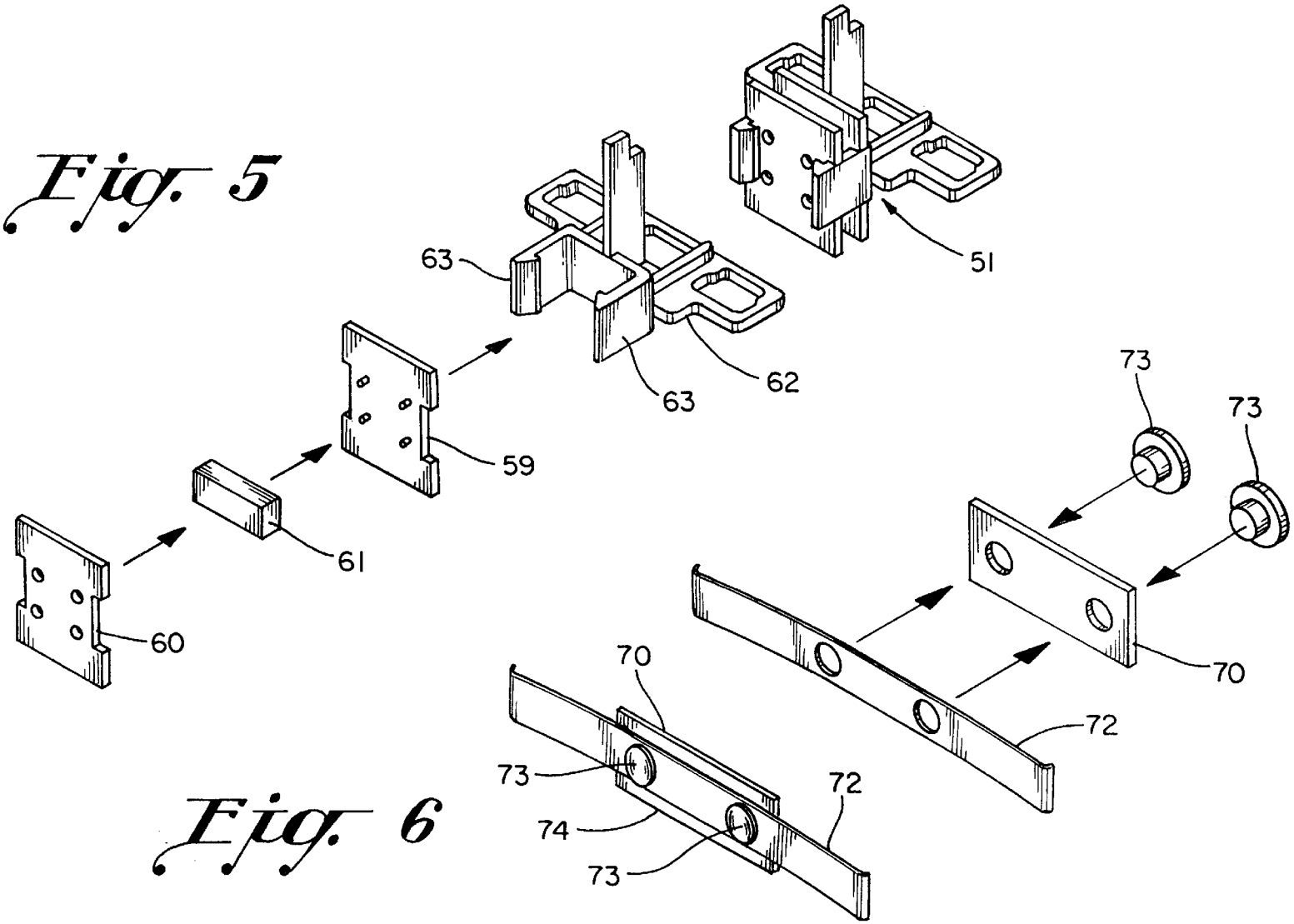
FIG. 5. An exploded view of the actuator assembly in the second embodiment of the present invention FIG. 6. An exploded view of the contact bridge, spring, and contact button linkage.

Referring to FIGS. 4, 5 a second embodiment of the actuator assembly 51 is needed in order to work cooperatively with the second embodiment of the relay motor 50. In this second embodiment of the actuator assembly 51, the first 59 and second pole pieces 60 are sheets of ferromagnetic material with a permanent magnet 61 sandwiched in between the pole pieces. An actuator frame 62 made of a nonconductive material, preferably plastic is operatively coupled to the first 59 and second 60 ferromagnetic pole pieces, and a permanent magnet 61. In the preferred embodiment, the coupling is achieved through a pair of clip portions 63 which secure the first 59 and second 60 ferromagnetic pole pieces and the permanent magnet 61 to the actuator frame 62.

Referring to FIG. 4, the actuator assembly is positioned so that a portion of the first 59 and second 60 pole pieces are located in between the second 57 and third 58 tongue portion on the second contact section 56 and that the first tongue portion 54 of the first contact section 55 is positioned in between the first 59 and second 60 pole pieces. The first 59 and second 60 pole pieces are magnetically coupled to a tongue portion on opposing contact sections.

Referring to FIGS. 1, 4, and 6, in the preferred embodiment of the present invention, a contact bridge assembly 74 comprising a spring 72 and a contact bridge 70 made of a sheet of conductive material preferably copper is operatively coupled to the actuator assembly 18. Referring to FIG. 4 in the second embodiment of the present invention, there are three contact bridges 70 operatively coupled to the actuator assembly 51. The preferred embodiment and the second embodiment can both function with either a single or a plurality of contact bridges being operatively coupled to their respective actuator assembly 18, 51.

Referring to FIGS. 1, 4, and 6, the contact bridge 70 serves as a conductive pathway between a pair of contact points 71 generally positioned across from the contact bridge 70. The conductive bridge 70 is connected to a spring 72, preferably a steel spring. The spring 72 is preferably C-shaped but coiled springs may also be used. The spring provides a force on the contact bridge sufficient to ensure good contact between the contact bridge and the contact points lying across from the contact bridge. A plurality of contact buttons 73 are also conductively connected to the contact bridge 70, the contact buttons 73 further ensuring that good contact is made between the contact bridge and the two contact points lying across from the contact bridge.

Since the contact bridge 70 forms the conductive pathway between the two contact points 71 and not the spring 72, the contact bridge can be made thicker and wider to allow for greater current flow, without affecting the properties of the spring. In the preferred embodiment and in the second embodiment of the present invention, the contact bridge is 1 millimeter thick and 10 millimeter wide, allowing the contact bridge to safely handle up to 200 amps without significant heat build up.

Referring to FIGS. 1 and 4, in the preferred embodiment and the second embodiment, a housing 28 or 64 encloses the components of the present invention. The housing 28 or 64 is preferably made of a nonconductive material and has contact terminal assemblies 25 or 65 attached thereto and extending through a wall of the housing. The contact terminal assemblies typically have isolated contact points 71 positioned across from the contact bridge 70. An air gap of typically 1.6 mm exists between the contact bridge and each contact point, with the gaps typically adding up to at least 3.0 mm. for safe disconnection of power. However, the air gaps can vary to accommodate different applications and different regulatory requirement.

Figure 7:
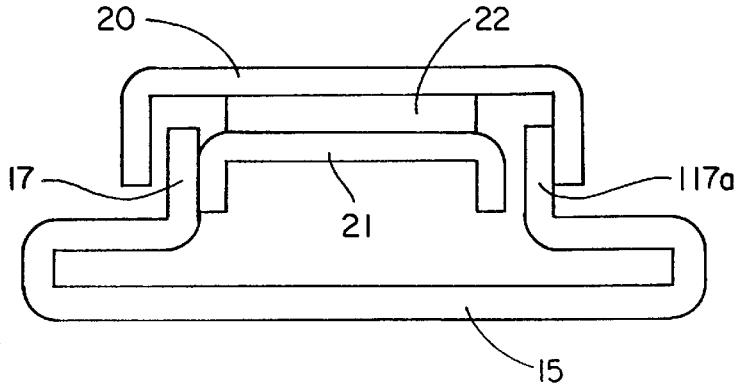
FIG. 7. A side view of the orientation of the pole piece with respect to the ferromagnetic frame in a first position in the preferred embodiment of the present invention.
Figure 8:
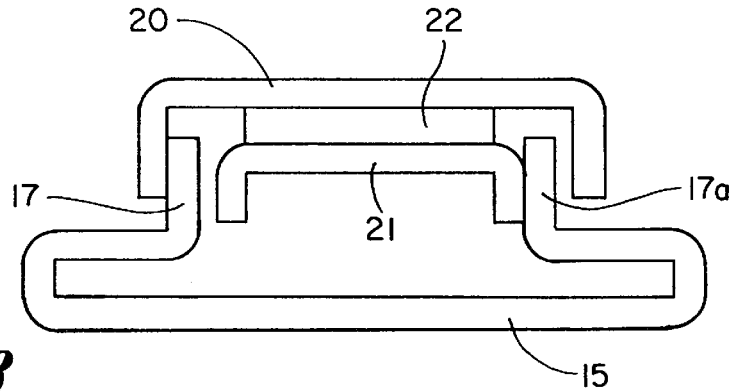
FIG. 8. A side view of the orientation of the pole piece with respect to the ferromagnetic frame in a second position in the preferred embodiment of the present invention.
Figure 9:
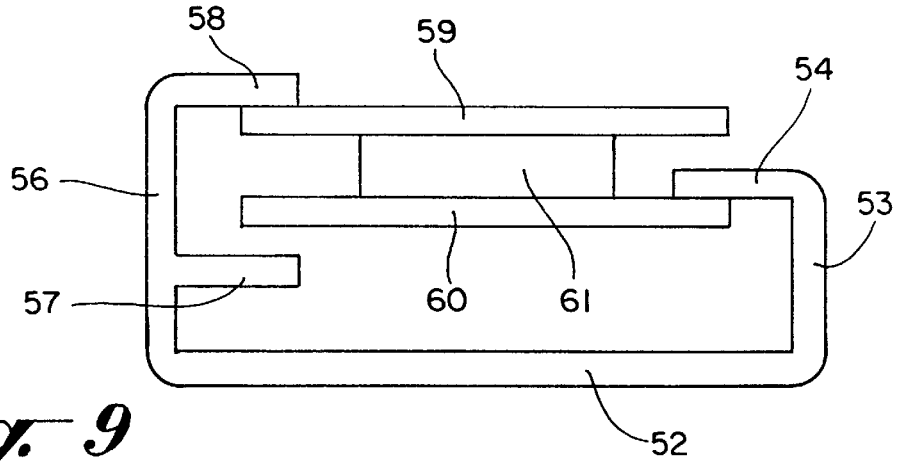
FIG. 9. A side view of the orientation of the pole piece with respect to the ferromagnetic frame in a first position in the second embodiment of the present invention.
Figure 10:
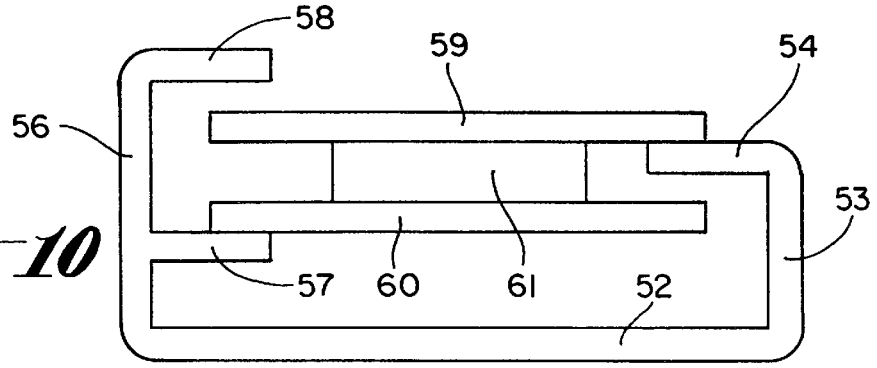
FIG. 10. A side view of the orientation of the pole piece with respect to the ferromagnetic frame in a second position in the second embodiment of the present invention.

Referring to FIGS. 1,4, the present invention is driven by the movement of the pole pieces 20, 21, 59, 60 in response to the polarity of a current running through the excitation coil 13, 66. A linear movement occurs when the polarity of the current running through the excitation coil 13, 66 causes the magnetic flux in the ferromagnetic frame 15, 52, to induce the first 20, 59 and second 21,60 pole pieces to magnetically couple to the contact sections opposite the contact section that they were previously magnetically coupled to. FIGS. 7 and 8 show the two positions, with respect to the ferromagnetic frame 15, in which the first 20 and second pole pieces 21 of the preferred embodiment linearly reciprocate between. FIGS. 9 and 10 show the two positions, with respect to the ferromagnetic frame 52, in which the first 59 and second 60 pole pieces of the second embodiment of this invention reciprocate between. This linear movement of the pole pieces 20, 21, 59, 60 drive the movement of the actuator assembly 18, 51 which then drives the contact bridge 70 into contact with a pair of contact points 71 positioned directly opposite the contact bridge 70, or drives the contact bridge 70 into breaking contact with the contact points 71.

The invention described above is the preferred embodiment of the present invention. It is not intended that the novel device be limited thereby. The preferred embodiment may be susceptible to modifications and variations that are within the scope and fair meaning of the accompanying claims and drawings.

I claim:

1. A latching magnetic relay assembly comprising:

a relay motor assembly comprising an elongated coil bobbin having an axially extending cavity therein and an excitation coil wound therearound, a generally U shaped ferromagnetic frame, the ferromagnetic frame having a plurality of core sections being disposed in and extending through the axially extending cavity in the elongated coil bobbin and a first and second contact sections extending generally perpendicularly to the core section and rising above the motor assembly;

an actuator assembly comprising an actuator frame operatively coupled to a first and a second generally U-shaped ferromagnetic pole pieces, and a permanent magnet, the first pole piece mounted in overlapping relation over the second pole piece, the permanent magnet lying sandwiched therebetween, the actuator assembly positioned so the second pole piece is located in between the first and second contact sections of the ferromagnetic frame and the first pole piece is located in overlapping relation across from the two contact sections of the relay motor, the first and second pole pieces magnetically coupled to opposite contact sections; and a contact bridge assembly, the contact bridge assembly comprising a contact bridge and a spring, the contact bridge of a conductive material and operatively coupled to the actuator assembly, the spring connected to the contact bridge, the movement of the actuator assembly either driving the contact bridge into contact with a pair of contact points positioned directly opposite the contact bridge, the contact bridge serving as a conductive pathway between the two contact points, or driving the contact bridge into breaking contact with the contact points, the movement of the actuator assembly driven by the relay motor.

2. The magnetic latching relay in claim 1 wherein the contact bridge is made of copper and has a width of 10 millimeters and a thickness of 1 millimeter.

3. The magnetic latching relay in claim 1 wherein a plurality of contact bridges and springs are operatively coupled to the actuator assembly.

4. The magnetic latching relay in claim 1 wherein a plurality of contact buttons are conductively connected to the contact bridge.

5. The magnetic latching relay in claim 1 further comprising a housing with a plurality of contact terminal assemblies attached thereto and extending through a wall of the housing, the relay motor, the actuator assembly, and the contact bridge being disposed within the housing, the contact terminal assembly having two isolated contact points positioned across the contact bridge, a gap of at least 1.6 mm separating the contact bridge and each contact point.

6. A magnetic relay assembly comprising:

a relay motor comprising a bobbin having an axially extending cavity therethrough and a conductive coil wound therearound, a generally U-shaped ferromagnetic frame having a core section disposed in and extending through the axially extending cavity in the bobbin, and having a first and a second contact section extending generally perpendicularly from opposite ends of the core section and rising above the bobbin, the first contact section having a first tongue portion extending generally perpendicularly from the first contact section and above the bobbin, the second contact section having a second and third tongue portions extending generally perpendicularly from the second contact section and above the bobbin, the second tongue portion lying below the third tongue portion;

an actuator assembly comprising an actuator frame operatively coupled to a first and a second ferromagnetic pole pieces, and a permanent magnet, the permanent magnet lying sandwiched in between the pole pieces, the actuator assembly positioned so a portion of the first and second pole pieces are located in between the second and third tongue portion on the second contact sections and the first tongue portion of the first contact section is positioned in between the first and second pole pieces, the first and second pole pieces magnetically coupled to opposing contact sections; and a contact bridge assembly, the contact bridge assembly comprising of a contact bridge and a spring, the contact bridge of a conductive material and operatively coupled to the actuator assembly, the spring connected to the contact bridge, the movement of the actuator assembly either driving the contact bridge into contact with a pair of contact points positioned directly opposite the contact bridge, the contact bridge serving as a conductive pathway between the two contact points, or driving the contact bridge into breaking contact with the contact points, the movement of the actuator assembly initiated by the relay motor.

7. The magnetic latching relay in claim 6 wherein the contact bridge is made of copper and has a width of 10 millimeters and a thickness of 1 millimeter.

8. The magnetic latching relay in claim 6 wherein a plurality of contact bridges and spring are operatively coupled to the actuator assembly.

9. The magnetic latching relay in claim 6 wherein a plurality of contact buttons are conductively connected to the contact bridge.

10. The magnetic latching relay in claim 6 further comprising a housing with a plurality of contact terminal assemblies attached thereto and extending through a wall of the housing, the relay motor, the actuator assembly, and the contact bridge being disposed within the housing, the contact terminal assemblies having two conductively isolated contact points positioned across the contact bridge so a gap of at least 1.6 mm separates the contact bridge and each contact point.

11. A latching magnetic relay assembly comprising:

a relay motor;

an actuator assembly magnetically coupled to the relay motor; and a contact bridge assembly, the contact bridge assembly comprising of a contact bridge and a spring, the contact bridge of a conductive material and operatively coupled to the actuator assembly, the spring connected to the contact bridge, the movement of the actuator assembly either driving the contact bridge into contact with a pair of contact points positioned directly opposite the contact bridge, the contact bridge serving as a conductive pathway between the two contact points, or driving the contact bridge into breaking contact with the contact points, the movement of the actuator assembly initiated by the relay motor.

12. The magnetic latching relay in claim 11 wherein the contact bridge is made of copper and has a width of 10 millimeters and a thickness of 1 millimeter.

13. The magnetic latching relay in claim 11 wherein a plurality of contact bridges are operatively coupled to the actuator assembly.

14. The magnetic latching relay in claim 11 wherein a plurality of contact buttons are conductively connected to the contact bridge.

15. The magnetic latching relay in claim 11 further comprising a housing with a plurality of contact terminal assemblies attached thereto and extending through a wall of the housing, the relay motor, the actuator assembly, and the contact bridge being disposed within the housing, the contact terminal assembly having two conductively isolated contact points positioned across the contact bridge so a gap of at least 1.6 mm separates the contact bridge and each contact point.

16. A latching magnetic relay assembly comprising:

a relay motor assembly comprising an elongated coil bobbin having an axially extending cavity therein and an excitation coil wound therearound, a generally U shaped ferromagnetic frame, the ferromagnetic frame having a plurality of core sections being disposed in and extending through the axially extending cavity in the elongated coil bobbin and a first and a second contact section extending generally perpendicularly to the core section and rising above the motor assembly;

an actuator assembly comprising an actuator frame operatively coupled to a first and a second generally U-shaped ferromagnetic pole pieces, and a permanent magnet, the first pole piece mounted in overlapping relation over the second pole piece, the permanent magnet lying sandwiched therebetween, the actuator assembly positioned so the second pole piece is located in between the first and second contact sections of the ferromagnetic frame and the first pole piece positioned in overlapping relation across from the two contact sections of the relay motor, the first and second pole pieces magnetically coupled to opposite contact sections; and means for conductive contact, the means for conductive contact operatively coupled to the actuator assembly, the movement of the actuator assembly either driving the means for conductive contact into contact with a pair of contact points positioned directly opposite the means for conductive contact, the means for conductive contact acting as a conductive pathway between the two contact points, or driving the means for conductive contact into breaking contact with the contact points, the movement of the actuator assembly initiated by the relay motor.

17. The magnetic latching relay in claim 16 wherein a plurality of means for conductive contact are operatively coupled to the actuator assembly.

18. The magnetic latching relay in claim 16 further comprising a housing with a contact terminal assembly attached thereto and extending through a wall of the housing, the relay motor, the actuator assembly, and the conductive contact means disposed within the housing, the contact terminal assembly having two conductively isolated contact points positioned across the means for conductive contact so a gap of at least 1.6 mm separates the means for conductive contact and each contact point.

19. The magnetic latching relay in claim 16 wherein a plurality of contact buttons are conductively connected to the means for conductive contact.

20. A magnetic relay assembly comprising:

a relay motor comprising a bobbin having an axially extending cavity therethrough and a conductive coil wound therearound, a generally U-shaped ferromagnetic frame having a plurality of core sections disposed in and extending through the axially extending cavity in the bobbin, and having a first and a second contact section extending generally perpendicularly from opposite ends of the core section and rising above the bobbin, the first contact section having a first tongue portion extending generally perpendicularly from the first contact section and above the bobbin, the second contact section having a second and third tongue portions extending generally perpendicularly from the second contact section and above the bobbin, the second tongue portion lying below the third tongue portion;

an actuator assembly comprising an actuator frame operatively coupled to a first and a second ferromagnetic pole pieces, and a permanent magnet, the permanent magnet lying sandwiched in between the pole pieces, the actuator assembly positioned so a portion of the first and second pole pieces are located in between the second and third tongue portion on the second contact sections and the first tongue portion of the first contact section positioned in between the first and second pole pieces, the first and second pole pieces magnetically coupled to opposing contact sections; and means for conductive contact, the means for conductive contact operatively coupled to the actuator assembly, the movement of the actuator assembly either driving the means for conductive contact into contact with a pair of contact points positioned directly opposite the conductive contact means, the means for conductive contact acting as a conductive pathway between the two contact points, or driving the means for conductive contact into breaking contact with the contact points, the movement of the actuator assembly being initiated by the relay motor.

21. The magnetic latching relay in claim 20 wherein a plurality of means for conductive contact are operatively coupled to the actuator assembly.

22. The magnetic latching relay in claim 20 further comprising a housing with a plurality of contact terminal assemblies attached thereto and extending through a wall of the housing, the relay motor, the actuator assembly, and the means for conductive contact being disposed within the housing, the contact terminal assembly having two conductively isolated contact points positioned across the means for conductive contact.

23. The magnetic latching relay in claim 20 wherein a plurality of contact buttons are conductively connected to the means for conductive contact.

* * * * *